US006164395A

United States Patent [19]

Fuller et al.

[11] Patent Number: 6,164,395

[45] **Date of Patent: *Dec. 26, 2000**

[54] CUTTING STRUCTURE FOR ROTARY DRILL BITS

[75] Inventors: John Michael Fuller, Nailsworth; Steven Taylor, Cheltenham; Malcolm Roy Taylor, Gloucester, all of United Kingdom

[73] Assignee: Camco International (UK) Limited, Stonehouse, United Kingdom

[ * ] Notice: This patent is subject to a terminal disclaimer.

[21] Appl. No.: 09/046,148

[22] Filed: Mar. 23, 1998

Related U.S. Application Data

[63] Continuation-in-part of application No. 08/949,178, Oct. 10, 1997, Pat. No. 5,992,549.

[30] Foreign Application Priority Data

| | | | |
|---|---|---|---|
| Oct. 11, 1996 | [GB] | United Kingdom | 9621216 |
| Aug. 20, 1997 | [GB] | United Kingdom | 9717505 |

[51] Int. Cl.[7] ..... E21B 10/46; E21B 10/62

[52] U.S. Cl. ..... 175/431; 175/432

[58] Field of Search ..... 175/431, 432, 175/379, 57, 429, 426, 428

[56] References Cited

U.S. PATENT DOCUMENTS

| | | | |
|---|---|---|---|
| 4,453,605 | 6/1984 | Short, Jr. . | |
| 4,538,690 | 9/1985 | Short, Jr. | 175/329 |
| 4,558,753 | 12/1985 | Barr | 175/431 |
| 4,574,895 | 3/1986 | Dolezal . | |
| 4,690,229 | 9/1987 | Raney . | |
| 4,942,933 | 7/1990 | Barr | 175/431 X |
| 5,115,873 | 5/1992 | Pastusek | 175/65 |
| 5,172,778 | 12/1992 | Tibbitts et al. | 175/65 |
| 5,199,511 | 4/1993 | Tibbitts et al. | 175/65 |
| 5,447,208 | 9/1995 | Lund et al. | 175/428 |

FOREIGN PATENT DOCUMENTS

| | | |
|---|---|---|
| 0284238 | 9/1988 | European Pat. Off. . |
| 2084219 | 4/1982 | United Kingdom . |

*Primary Examiner*—Frank S. Tsay
*Attorney, Agent, or Firm*—Jeffery E. Daly

[57] ABSTRACT

A cutting structure for a rotary drag-type drill bit includes a cutting element mounted on a member on the bit body, which may be a carrier secured to the bit body or part of the bit body itself. The surface of the member on which the cutting element is mounted is formed with a groove, adjacent the cutting element. The downstream end of the groove is located near a nozzle in the bit body through which a jet of drilling fluid emerges, so that the groove directs to the front of the cutting element the flow of drilling fluid which impinges on the groove. An array of separate grooves may lead from the nozzle to different cutting elements. The flow of drilling fluid directed towards each cutting element serves to break up cuttings removed from the formation by the cutting element and to carry the cuttings away from the element.

17 Claims, 3 Drawing Sheets

FIG 1
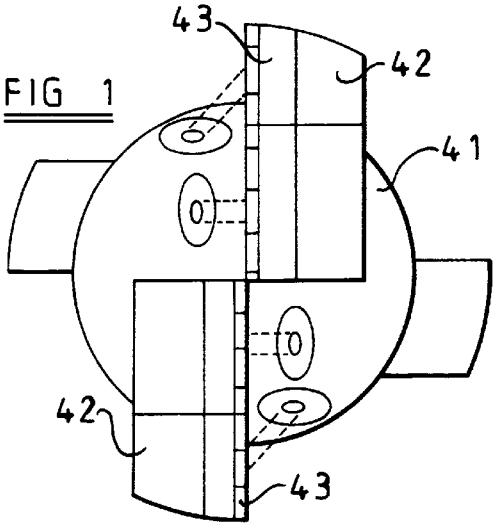
FIG 2
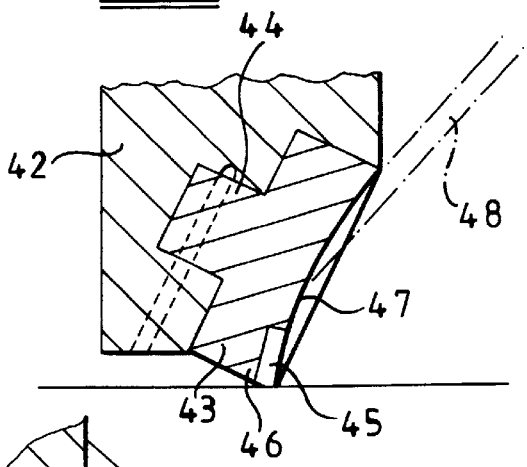
FIG 3
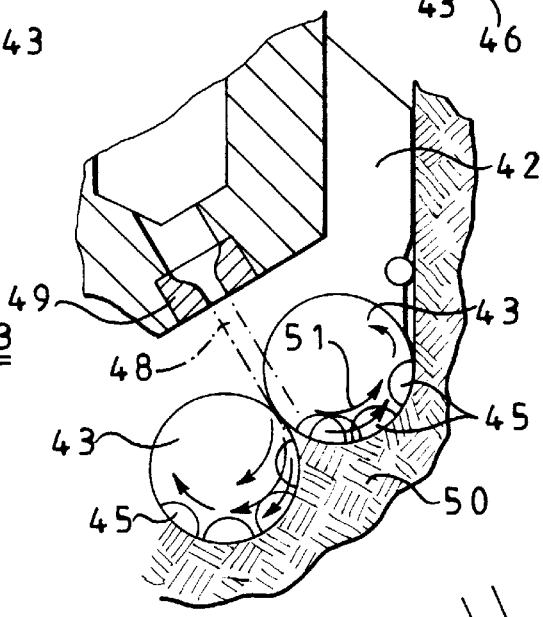
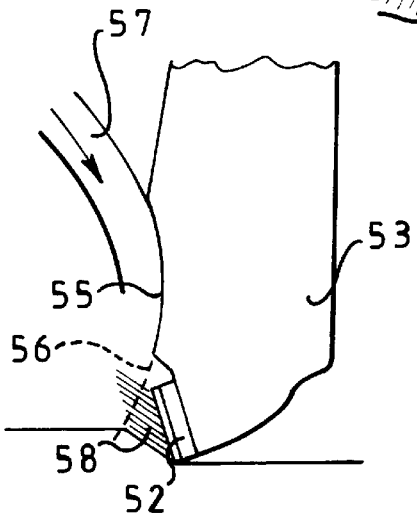
FIG 4
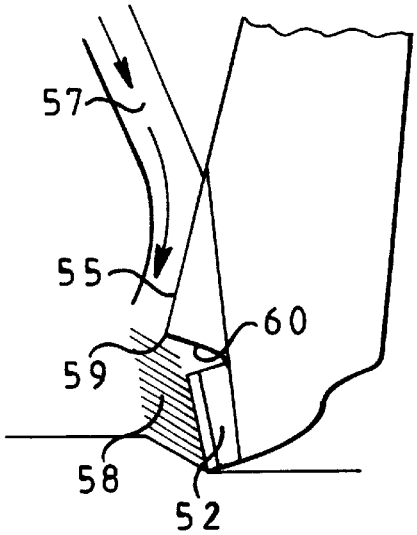
FIG 5

FIG 6
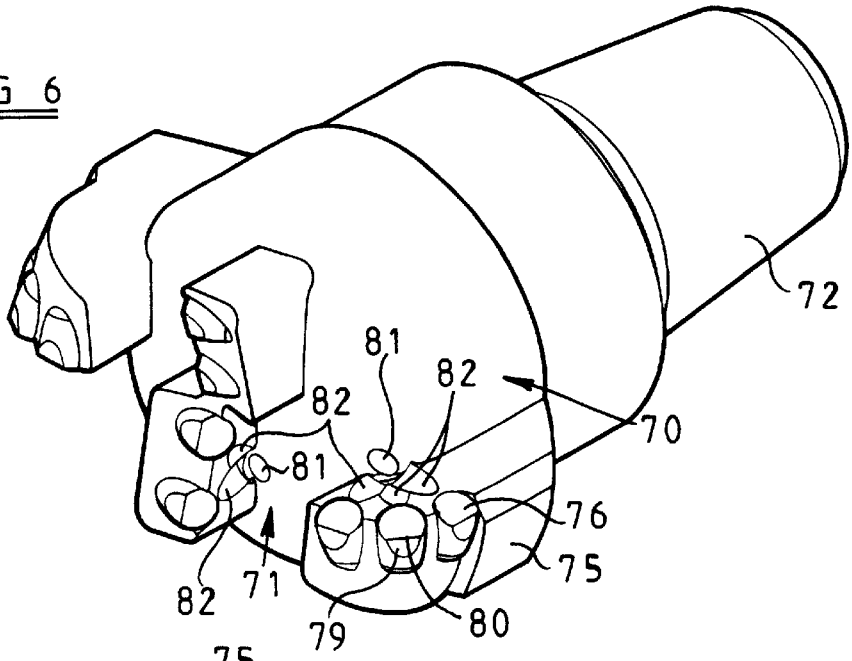
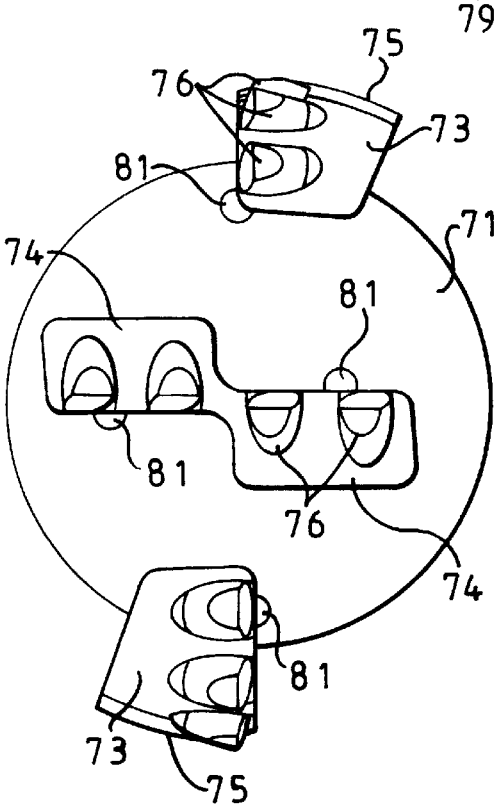
FIG 7
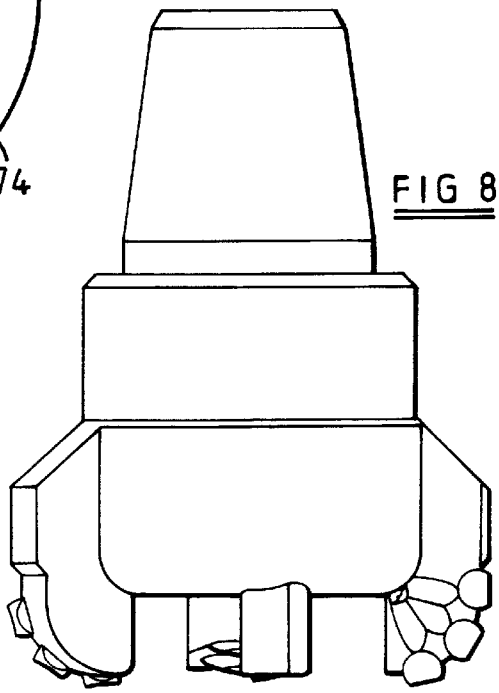
FIG 8

CUTTING STRUCTURE FOR ROTARY DRILL BITS

CROSS-REFERENCE TO RELATED APPLICATION

This is a Continuation-in-Part of U.S. patent application Ser. No. 08/949,178, filed Oct. 10th, 1997, by John Michael Fuller, entitled "Cutting Structures for Rotary Drill Bits" now U.S. Pat. No. 5,992,549.

BACKGROUND OF THE INVENTION

1. Field of the Invention

The invention relates to cutting structures for rotary drag-type drill bits, for use in drilling or coring holes in subsurface formations, and of the kind comprising a bit body having a shank for connection to a drill string, a plurality of cutting structures at the surface of the bit body, and a passage in the bit body for supplying drilling fluid to the surface of the bit body for cooling and/or cleaning the cutters. Each cutting structure may include a preform cutting element of the kind comprising a front facing table of superhard material bonded to a less hard substrate. The cutting element may be mounted on a carrier, also of a material which is less hard than the superhard material, which is mounted on the body of the drill bit, for example, is secured within a socket on the bit body. Alternatively, the cutting element may be mounted directly on the bit body, for example the substrate may be of sufficient axial length that it may itself be secured within a socket on the bit body.

2. Description of Related Art

In drag-type drill bits of this kind the bit body may be machined from metal, usually steel, and sockets to receive the carriers or the cutting elements themselves are machined in the bit body. Alternatively, the bit body may be moulded from tungsten carbide matrix material using a powder metallurgy process.

Drag-type drill bits of this kind are particularly suitable for drilling softer formations. However, when drilling soft, sticky shale formations in a water based mud environment, and in other similar conditions, there may be a tendency for the shavings or chips of formation gouged from the surface of the borehole not to separate from the surface and to be held down on the surface of the formation by the subsequent passage over the shaving or chip of other cutters and parts of the drill bit. Also, there may be a tendency for such material to adhere to the surface of the bit body, a phenomenon known as "bit balling", eventually resulting in the bit becoming ineffective for further drilling.

The present invention sets out to provide improved forms of cutting structure for a rotary drag-type drill bit where these problems may be alleviated or overcome.

SUMMARY OF THE INVENTION

According to the invention there is provided a cutting structure for a rotary drag-type drill bit including a cutting element mounted on a member on the bit body, wherein a portion of the member on which the cutting element is mounted has a surface which is shaped, adjacent the cutting element, to direct to a location in front of the cutting element, with respect to the normal direction of forward movement of the cutting element in use, a flow of drilling fluid which impinges on said surface.

Said shaped surface may comprise a groove extending away from the surface of the bit body towards the cutting element, so as to direct towards the cutting element fluid flowing over the surface of the bit body.

Preferably the groove has a downstream end adjacent the cutting element and an upstream end located adjacent a nozzle in the bit body through which drilling fluid is delivered to the surface of the bit body, whereby fluid emerging from the nozzle is at least partly directed along the groove.

There may provided a group of two or more of said grooves delivering drilling fluid to a number of cutting elements, the upstream ends of all the grooves in the group being located adjacent a single nozzle in the bit body, whereby fluid is delivered along all the grooves in the group from said nozzle. The group of grooves may deliver fluid from the single nozzle to any number of cutting elements, for example to two, three or four cutting elements. Preferably there is provided a separate groove for each cutting element, but the invention does not exclude arrangements where at least one of the grooves in the group delivers drilling fluid to two or more cutting elements. For example, the grooves in a group may include a single groove which branches one or more times into a plurality of subsidiary grooves leading to a plurality of different cutting elements.

The member on which the preform element is mounted may comprise a part of the bit body itself or a carrier which is in turn mounted on the bit body.

In this case said shaped surface may be formed, at least in part, in a surface of a blade which is leading with respect to the normal direction of rotation of the drill bit in use.

For example, the member may comprise an upstanding blade formed on the bit body and extending outwardly, for example generally radially, from the central axis of rotation of the drill bit.

The bit body may be formed with a plurality of such blades spaced circumferentially apart around the bit body, each blade having a plurality of cutting elements mounted side-by-side along the blade.

In the case where a group of two or more grooves delivers fluid to a number of cutting elements from a single nozzle, all of the cutting elements on a blade may receive drilling fluid from a single nozzle through a single group of grooves.

Each group may comprise two or three grooves delivering fluid to the same number of cutting elements.

Preferably said shaped surface is formed on a portion of said member which overhangs the front surface of the facing table of the cutting element. Preferably the surface has an edge adjacent the cutting element, and an imaginary extension of the surface beyond said edge is spaced forwardly of the cutting element.

Preferably the shaped surface is smoothly and concavely curved as it extends towards the cutting element.

Said shaped surface may be hard faced, for example may have a surface coating of hard facing material applied thereto. Alternatively, the shaped surface may include a portion faced with superhard material. For example, a preform compact, comprising a front facing table of superhard material bonded to a less hard substrate, may be mounted on the member so that the front face of the superhard material forms part of said shaped surface on the member.

In any of the above arrangements, each cutting element may be a preform cutting element comprising a front facing table of superhard material bonded to a less hard substrate.

The cutting element may be substantially cylindrical, the substrate being of sufficient axial length to be received and secured within a cylindrical socket in the bit body.

Each cutting element may be of generally circular cross-section and may have a substantially straight cutting edge formed by a substantially flat bevel in the facing table and substrate which is inclined to the front surface of the facing table as it extends rearwardly therefrom.

According to a second aspect of the invention, there is provided a cutting structure for a rotary drag-type drill bit comprising a plurality of cutting elements mounted on the bit body, the cutting elements being so located and orientated that cuttings cut by the elements from the formation being drilled tend to converge towards a particular region of the bit body, the bit body including a nozzle for delivering drilling fluid to the surface of the bit body, said nozzle being located and orientated to deliver drilling fluid to said region of the bit body towards which the cuttings from the cutting elements converge.

BRIEF DESCRIPTION OF THE DRAWINGS

FIG. 1 is an end view of a rotary drag-type drill bit incorporating cutting structures according to the invention.

FIG. 2 is a diagrammatic section through a cutting structure, according to the invention, used on the drill bit of FIG. 1.

FIG. 3 is a diagrammatic vertical half-section through the drill bit of FIG. 1, FIGS. 4 and 5 are diagrammatic sections through further forms of cutting structure according to the invention.

FIG. 6 is a diagrammatic perspective view of a drag-type drill bit incorporating the invention.

FIG. 7 is an end view of the drill bit of FIG. 6.

FIG. 8 is a side view of the drill bit of FIG. 6.

FIG. 1 is an end view of a drill bit having cutting structures according to the invention. The bit body 41 is formed with two blades 42, as best seen in FIGS. 2 and 3, and each blade 42 has two circular carriers 43 mounted side-by-side thereon. Each carrier 43 is generally circular and is formed on its rear surface with a cylindrical stud portion 44 received in an appropriately shaped socket in the blade 42.

Figure 9:
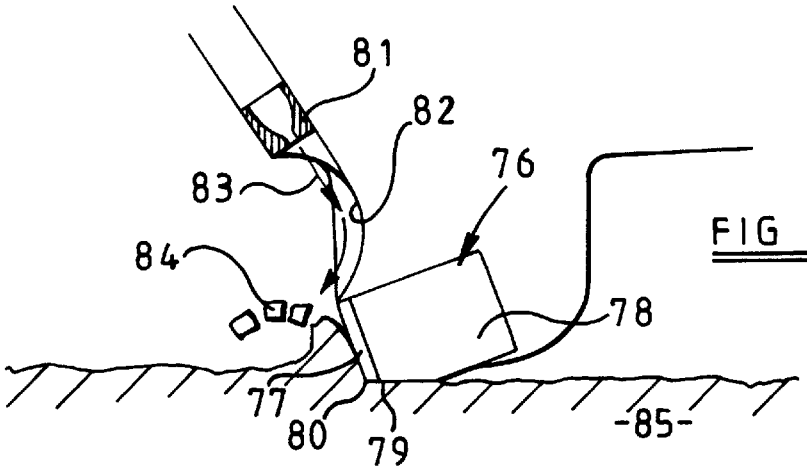
FIG. 9 is a diagrammatic section through a cutting structure of the drill bit shown in FIGS. 6–8.

As best seen in FIG. 3, each carrier 43 has mounted around the lowermost portion of its periphery a number of generally semi-circular preform cutting elements 45. Each cutting element 45 comprises a facing table of polycrystalline diamond bonded to a substrate of tungsten carbide and is brazed within a suitably shaped socket 46 in the circular carrier 43. The front face of the carrier 43 is formed with a part-spherical concave surface 47 which performs two functions. The concave surface 47 serves to break up cuttings cut from the formation by the cutting elements 45, and also directs a jet of drilling fluid 48 from a nozzle 49 associated with the carrier downwardly past the cutting element 45 and on to the formation in front of the cutting element. This serves to further assist in the break up of the cuttings and also to clean the chips of formation from the front of the cutting elements 45 as they are broken up.

As best seen in FIG. 3, the shape of the carriers 43 forms two part-circular groove side-by-side in the formation 50 and the nozzle 49 is so located that the jet 48 of drilling fluid flows around the bottom of the grooves in the formation and sweeps across the cutting elements 45 as indicated by the arrows 51.

FIG. 4 is a diagrammatic section through a cutting structure comprising a polycrystalline diamond preform element 52 mounted on a cemented tungsten carbide carrier 53 which is received in a socket in the bit body (not shown). In this case a portion of the carrier on the side of the cutting element 52 remote from its cutting edge is formed with a concavely curved surface 55 an imaginary extension of which, as indicated in dotted lines at 56, is spaced forwardly of the cutting element 52. In this case a jet 57 of drilling fluid is directed downwardly by the curved surface 55 so as to impinge on chips 58 of formation being raised from the surface of the borehole by the cutting element 52 and breaks the chips away from the cutting element and from the surface of the formation as a result of the hydraulic pressure.

FIG. 5 shows a modified arrangement where the hydraulic effect of FIG. 4 is combined with mechanical break up of the cuttings of formation. In this case the edge 59 of the concavely curved surface 55 is located forwardly of the front surface of the cutting element 52 so that the chips of formation 58 impinge on the undersurface 60 and are thus mechanically broken up in addition to the breaking up effect of the jet 57 of drilling fluid.

In the arrangements of FIGS. 4 and 5, a PDC element may be set into the surface 55 to resist erosion of the surface by the jet of drilling fluid.

In any of the above arrangements of FIGS. 1–7 where a jet of drilling fluid is directed so as to impinge on chips of formation being raised from the surface of the borehole by a cutting element, the surface over which the jet flows may be formed with a groove to direct at least part of the jet towards the cutting element. The groove in the surface then has an upstream end adjacent the nozzle through which the drilling fluid is delivered to the surface of the bit body and a downstream end located adjacent the cutting element to which the fluid is to be directed.

FIGS. 6–9 show an arrangement where groups of two or three such grooves direct drilling fluid to respective cutting elements, the upstream ends of all the grooves in each group being located adjacent a single nozzle in the bit body, so that fluid is delivered along the grooves to all the cutting elements from that nozzle.

Referring to FIGS. 6–9: the drag-type drill bit comprises a bit body 70 having an end face 71 and formed with a tapered threaded pin 72 for connecting the drill bit to a drill string in known manner. The end face 71 of the bit body is formed with four upstanding blades 73, 74 which extend outwardly away from the central longitudinal axis of rotation of the drill bit. The inner two blades 74 are joined at the centre of the bit whereas the outer two blades 73 are widely separated and are connected to respective kickers 75 which engage the walls of the borehole being drilled, in use, so as to stabilize the bit within the borehole. Each inner blade 74 is formed with two spaced cutters 76 and each outer blade 73 is formed with three spaced cutters 76.

Each cutter 76 is generally cylindrical and is a preform cutter comprising a front facing table 77 (see FIG. 9) of polycrystalline diamond bonded to a cylindrical substrate 78 of cemented tungsten carbide. The substrate is received and secured in a socket in the respective blade 73 or 74.

Each cutter 76 is formed with an inclined bevel 79 which is inclined to the front face of the facing table 77 so as to form a generally straight cutting edge 80.

The purpose of the inclined bevel 79 on the cutter 76 is to limit the depth of cut of the cutters. This feature reduces the rate of penetration of the drill bit and hence reduces the volume of cuttings (chips or shavings) produced with respect to time and hydraulic flow. This therefore facilitates the removal of the cuttings as they are formed.

The cutters 76 are arranged at different distances from the central axis of rotation of the drill bit so that, as the bit rotates, the cutters between them sweep over the whole of the bottom surface of the borehole so as to define a substantially continuous cutting profile.

On the leading side of each blade 73, 74, there is mounted in the leading surface 71 of the drill bit a nozzle 81 for delivering drilling fluid to the surface of the drill bit. As is well known, drilling fluid under pressure is delivered downhole through the drill string and through a central passage in the bit body and subsidiary passages leading to the nozzles 81. The purpose of the drilling fluid is to cool and clean the cutters and to carry back to the surface cuttings or chips removed from the formation by the cutters. Drilling fluid emerging from the nozzles normally flows outwardly across the leading surface of the bit body so as to be returned to the surface through the annulus between the drill string and the surrounding formation of the borehole.

In a common prior art arrangement the cutters on the blades face into channels defined between the blades, which cutters extend outwardly from the central axis of the drill bit to junk slots at the periphery. The nozzles are located and orientated to cause fluid to flow outwardly along these channels and, in so doing, to wash over the cutters so as to clean and cool them. According to the present invention, however, means are provided for directing the flow of drilling fluid more specifically on to individual cutters.

As best seen in FIGS. 6 and 9, each nozzle 81 is located adjacent the downstream ends of two or three grooves 82 which are formed in the leading surface of the associated blade 73 or 74 and are orientated to direct fluid from the nozzle 81 to the respective cutters 76 on the blade.

As best seen in FIG. 9, fluid discharged from the nozzle 81 is directed along each of the grooves 82, as indicated by the arrows 83, so as to impinge on a cutting 84 being raised from the formation 85 by the cutter 76. The hydraulic pressure of the jet of fluid serves to break up the cutting 84 into smaller chips so that it is more easily detached from the surface of the formation and entrained in the flow of drilling fluid.

The arrangement of FIGS. 6–9 is particularly advantageous in drill bits for drilling soft and sticky formations such as plastic shales. The provision of the grooves 82 concentrates the hydraulic energy in the drilling fluid emerging from each nozzle directly on to the individual cutters. The grooves split up the flow from each nozzle and form discrete jets of fluid to impact on the cuttings of formation being removed by the cutter.

Although the arrangement shows a separate groove 82 for each cutter, arrangements are possible where a groove may serve two or more closely adjacent cutters, although the described arrangement is preferred. Although the cutter arrangement shown in FIGS. 6–8 is preferred, the number and type of cutter on each blade may be varied.

In an alternative arrangement one or more grooves in a group of grooves leading from a single nozzle to a plurality of cutting elements may branch one or more times into a plurality of subsidiary grooves leading to the cutting elements. One such arrangement is shown, by way of example, in FIG. 10.

Figure 10:
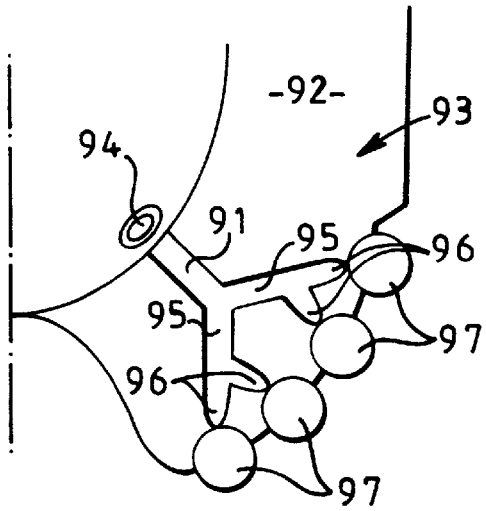
FIG. 10 is a diagrammatic representation of an alternative form of cutting structure according to the invention.

In the arrangement of FIG. 10 a single main groove 91 in the leading surface 92 of a blade 93 communicates at its upstream end with a single nozzle 94. The groove 91, as it extends away from the nozzle 94, branches into two primary subsidiary grooves 95 each of which branches again so as to provide four secondary subsidiary grooves 96 which lead at their downstream ends to four cutting elements 97 respectively. The group of branching main and subsidiary grooves therefore serves to direct drilling fluid from the single nozzle 94 to the four spaced cutting elements 97. It will be appreciated that many other arrangements of main grooves and subsidiary grooves may be provided for distributing the flow from one or more nozzles to a greater number of cutting elements. The ratio of the number of nozzles with respect to the number of cutting elements to which fluid from the nozzles is delivered may have any value. In the arrangement of FIGS. 6–8 the ratio of nozzles to cutters is 1:2 or 1:3 whereas in the arrangement of FIG. 10 the ratio is 1:4.

Figure 11:
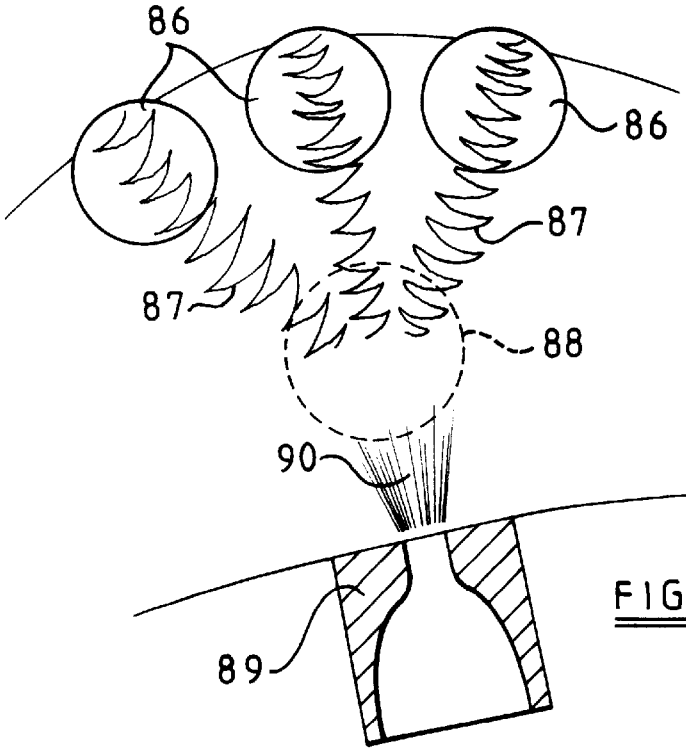
FIG. 11 is a diagrammatic representation of a further form of cutting structure in accordance with the invention.

In the alternative arrangement shown diagrammatically in FIG. 11, a number of adjacent cutters 86 are so orientated that the cuttings raised from the formation by the cutters, as indicated diagrammatically at 87, tend to converge towards the same region of the bit body, as indicated diagrammatically at 88. An adjacent nozzle 89 mounted in the bit body is so located and orientated as to direct a jet of drilling fluid 90 towards the region 88. Thus, with this arrangement a single nozzle directs its hydraulic energy towards all the cuttings produced by the cutters 86 in a single concentrated location, thereby tending to break up all of the cuttings into chips so that they are detached from the formation and more easily entrained in the drilling fluid.

Whereas the present invention has been described in particular relation to the drawings attached hereto, it should be understood that other and further modifications, apart from those shown or suggested herein, may be made within the scope and spirit of the present invention.

What is claimed:

1. A cutting structure for a rotary drag-type drill bit including a cutting element mounted on a member on a bit body, wherein a portion of the member on which the cutting element is mounted has a surface which is shaped, adjacent the cutting element, to direct to a location in front of the cutting element, with respect to the normal direction of forward movement of the cutting element in use, a flow of drilling fluid which impinges on said surface, wherein said shaped surface is formed on a portion of said member which overhangs the front surface of the facing table of the cutting element, and wherein the shaped surface has an edge adjacent the cutting element, and an imaginary extension of the surface beyond said edge is spaced forwardly of the cutting element.

2. A cutting structure according to claim 1, wherein said shaped surface comprises a groove extending away from the surface of the bit body towards the cutting element, so as to direct towards the cutting element fluid flowing over the surface of the bit body.

3. A cutting structure according to claim 2, wherein the groove has a downstream end adjacent the cutting element and an upstream end located adjacent a nozzle in the bit body through which drilling fluid is delivered to the surface of the bit body, whereby fluid emerging from the nozzle is at least partly directed along the groove.

4. A cutting structure according to 3, wherein there is provided a group of at least two grooves delivering drilling fluid to a number of cutting elements, the upstream ends of all the grooves in the group being located adjacent a single nozzle in the bit body, whereby fluid is delivered along all the grooves in the group from said nozzle. .

5. A cutting structure according to claim 4, wherein there is provided a separate groove for each cutting element.

6. A cutting structure according to claim 4, wherein at least one of the grooves in the group delivers drilling fluid to at least two cutting elements.

7. A cutting structure according to claim 6, wherein the grooves in a group include a single groove which branches at least once into a plurality of subsidiary grooves leading to a plurality of different cutting elements.

8. A cutting structure according to claim 1, wherein the member on which the cutting element is mounted comprises a part of the bit body itself.

9. A cutting structure according to claim 1, wherein the member on which the cutting element is mounted comprises a carrier which is in turn mounted on the bit body.

10. A cutting structure according to claim 9, wherein said shaped surface is formed, at least in part, in a surface of a blade which is leading with respect to the normal direction of rotation of the drill bit in use.

11. A cutting structure according to claim 10, wherein said member comprises an upstanding blade formed on the bit body and extending outwardly from the central axis of rotation of the drill bit.

12. A cutting structure according to claim 1, wherein the shaped surface is smoothly and concavely curved as it extends towards the cutting element.

13. A cutting structure according to claim 1, wherein said shaped surface is hard faced.

14. A cutting structure according to claim 13 wherein said shaped surface includes a portion faced with superhard material.

15. A cutting structure according to claim 14, wherein a preform compact, comprising a front facing table of superhard material bonded to a less hard substrate, is mounted on the member so that the front face of the superhard material forms part of said shaped surface on the member.

16. A cutting structure according to claim 1, wherein the cutting element comprises a preform cutting element including a front facing table of superhard material bonded to a less hard substrate.

17. A cutting structure according to claim 16, wherein the cutting element is substantially cylindrical, the substrate being of sufficient axial length to be received and secured within a cylindrical socket in the bit body.

* * * * *